United States Patent [19]

Hess

[11] 4,203,706

[45] May 20, 1980

[54] RADIAL WAFER AIRFOIL CONSTRUCTION

[75] Inventor: W. Graig Hess, Lake Park, Fla.

[73] Assignee: United Technologies Corporation, Hartford, Conn.

[21] Appl. No.: 865,356

[22] Filed: Dec. 28, 1977

[51] Int. Cl.[2] ..... F01D 5/18

[52] U.S. Cl. ..... 416/97 A; 416/229 R; 415/115

[58] Field of Search ..... 416/96 A, 97 R, 97 A, 416/229 R, 229 A, 231, 232; 415/115, 117

[56] References Cited

U.S. PATENT DOCUMENTS

| | | | |
|---|---|---|---|
| 3,301,526 | 1/1967 | Chamberlain | 416/97 |
| 3,420,502 | 1/1969 | Howald | 416/96 |
| 3,515,499 | 6/1970 | Beer et al. | 416/229 |
| 3,542,486 | 11/1970 | Kerchsr et al. | 415/115 |
| 3,781,130 | 12/1973 | Tall | 416/97 |
| 3,872,563 | 3/1975 | Brown et al. | 416/97 |

FOREIGN PATENT DOCUMENTS

| | | | |
|---|---|---|---|
| 1257041 | 12/1971 | United Kingdom | 416/97 |
| 1446045 | 8/1976 | United Kingdom | 416/97 |

*Primary Examiner*—Everette A. Powell, Jr.
*Assistant Examiner*—A. N. Trausch, III
*Attorney, Agent, or Firm*—Jack N. McCarthy

[57] ABSTRACT

A blade is disclosed having an upper airfoil configuration and a lower platform with a root constructed with conventional fir-tree design. The forward part of the blade is formed of radial wafers wherein desired configurations of cooling passageways can be formed on mating surfaces of the wafers so that bonding of these wafers together forms intricate internal passageways. Film cooling is shown on the pressure side of the blade, while convection cooling and some film cooling is shown on the suction side. The radial wafers of the forward part are open at the center thereof to provide a cavity in a finished blade for a cooling fluid to flow from an opening in the root thereof to the internal passageways. The cavity extends to the top of the blade and is covered by a tip cap. The cap extends over the side wafers of the rearward part. The rearward part of the blade is formed of side wafers with one forming the suction side of the blade, while the other forms the pressure side of the blade. The abutting surfaces of the side wafers are formed having wavy, criss-crossing grooves for receiving cooling fluid from said cavity and directing it out the trailing edge of the blade. Another modification includes a thin plate between the mating surfaces of the side wafers.

4 Claims, 5 Drawing Figures

FIG. 1
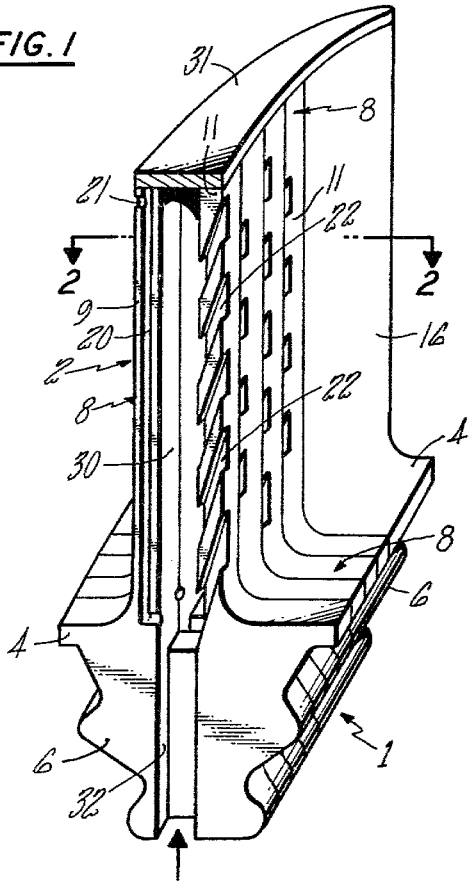
FIG. 3A
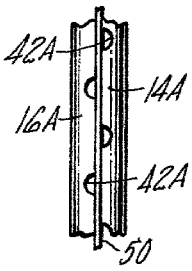
FIG. 3
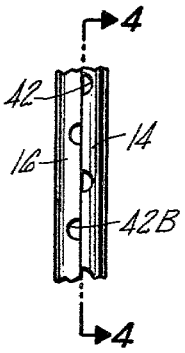
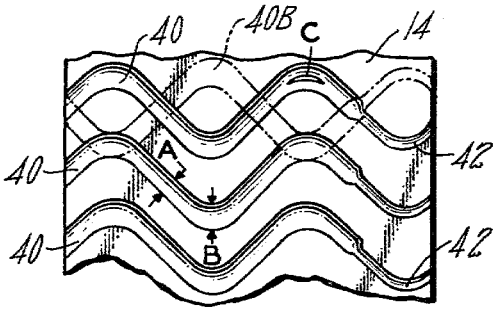
FIG. 4
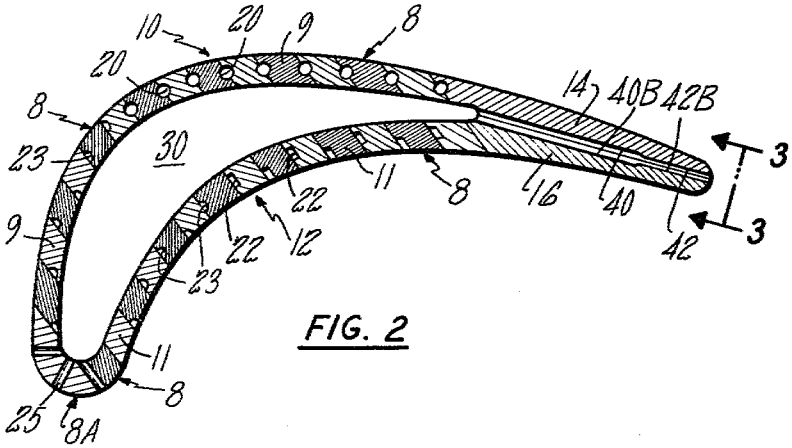
FIG. 2

RADIAL WAFER AIRFOIL CONSTRUCTION

BACKGROUND OF THE INVENTION

This invention relates to the construction of a blade wherein the upper part of the blade is of airfoil contour and the lower part is a root connected ot a disc of a turbine engine, or the construction of a vane having a section of airfoil contour directing flow to and from rotating blades, and the blade or vane includes radial wafers to promote cooling. In the past, the trailing edge region of turbine airfoils has been formed by convective cooling geometries of drilled passages or cast pedestals. The trailing edge region of turbine airfoils has been difficult to cool because (1) the cooling air is hot when it arrives at the trailing edge since it has been used to cool other portions of the airfoil and (2) the trailing edge region thickness is relatively thin. Prior art patents showing blades of airfoil contour are U.S. Pat. Nos. 3,515,499 and 3,872,563.

SUMMARY OF THE INVENTION

A primary object of the present invention is to provide a vane or blade having a section of airfoil configuration having improved convection features in the trailing edge that minimize film cooling on the suction side which is detrimental to aerodynamic performance.

It is another object of the present invention to provide a blade or vane with an airfoil section wherein the rearward part thereof is comprised of two side wafers having a plurality of wavy grooves extending from a center cavity in the blade to the trailing edge. The wavy criss-cross grooves on the meeting surfaces of the side wafers form a criss-cross pattern.

It is a further object of this invention to provide a blade or vane wherein a flat plate is placed between the two side wafers, separating the flow through the wavy criss-cross grooves of the separate side wafers.

It is another object of this invention to provide a blade or vane which can be used to reduce the number of blades or vanes in a conventional installation while maintaining at least the same aerodynamic performance.

BRIEF DESCRIPTION OF THE DRAWINGS

FIG. 1 is a perspective view of a part of a finished blade showing the radial wafer airfoil construction;

FIG. 2 is a section taken through a blade showing the airfoil contour and the trailing edge region side wafers;

FIG. 3 is a section view taken along the line 3—3 showing the trailing edge of the blade;

FIG. 3A is a view similar to Fig. 3 showing a modification wherein a thin plate is located between the side wafers; and FIG. 4 is a view taken in the direction of the line 4—4 of FIG. 3 showing the cooling passage construction therein.

DESCRIPTION OF THE PREFERRED EMBODIMENT

FIG. 1 shows the rear part of a finished blade 1 with the upper portion 2 of airfoil construction and having a platform 4 and root 6. The forward part of the blade is formed of wafers 8 aligned substantially parallel, one with the other, with the upper ends of wafers 8 forming portions of the surface of the suction side 10 and the pressure side 12 thereof, while the rearward portion of the blade 1 is formed from two side wafers 14 and 16 which extend in an axial direction with their forward ends connected to the rearward facing side of the last wafer 8 so that the sides of the wafers 14 and 16 form the downstream surface of the suction side 10 and the pressure side 12, respectively. The wafers 8, 14 and 16 extend downwardly to form the platform 4 and root 6. However, in a vane construction, the upper and lower ends of the wafers 8, 14 and 16 can merely consist of flanges to fix them in position, or the upper and lower ends of the vanes could fit into contoured openings in supporting annular shrouds.

The wafers 8, from the second wafer 8 to the last wafer 8 before the side wafers 14 and 16, have each had the center section removed to form side wall sections 9 and 11. The side wall sections 9 of each radial wafer 8 mate to form the suction side of the forward part of the blade 1, while the side wall sections 11 of each radial wafer 8 mate to form the pressure side of the forward part of the blade 1. The forwardmost radial wafer 8A forms the leading edge of the blade 1. This construction forms an open cavity 30 within the blade 1 above the root 6. The open cavity 30 extends to the top of the wafers 8 and is covered by a tip cap 31. This cap 31 also extends over the top of the side wafers 14 and 16 of the rearward part of the blade 1. Passageways 32 are placed in the root section of wafers 8 to provide a coolant fluid entry into the bottom of the cavity 30. These passageways 32 can be placed in one or more wafers, depending on the amount of cooling fluid desired. A coolant source and connecting conduits are not shown.

When the wafers 8, 14 and 16 are in their wafer form prior to being contoured to provide for internal passageways when the wafers 8 are assembled, the type of cooling desired for various portions of the blade are determined. If it is desired for a blade wall area to be cooled by convection, grooves 20 are placed on the meeting surfaces of side wall sections 9 of adjacent wafers 8 so that at the completion of the blade a tubular passageway will be formed in a blade wall as shown in FIG. 2 between the last nine wafers 8 on the suction side of the blade. Grooves 20 at their bottom end open into the removed center section of the wafer 8 which forms the cavity 30 of the completed blade 1 with adjacent wafers. The top of each groove 20 is connected through a short groove 21 to the suction side of the blade 1. However, an opening could be placed in the tip cap 31 so that this flow of cooling fluid in the tubular passageways made by mating grooves 20 could pass through the top of the blade.

If it is desired for a blade wall area to be cooled by film cooling, a plurality of grooves 22 are placed on one of the meeting surfaces of side wall sections 11 of adjacent wafers 8 so that at the completion of the blade, a plurality of passageways will extend from the open cavity 30 to the exterior of the blade surface. This type of structure is shown in FIG. 2 in the last seven wafers 8 on the pressure side of the blade; the remaining wall sections are shown having smaller grooves 23 which extend from the open cavity 30 to an exterior surface of the blade. If desired, the wall sections 11 could have no passageways therein. The forwardmost radial wafer 8A has short straight cooling passages 25.

The side wafers 14 and 16 which are bonded together to form the trailing portion of the blade 1 have their forward ends bonded respectively to the side wall sections 9 and 11 of the last wafer 8. Meeting surfaces of the side wafers 14 and 16 have a plurality of wavy grooves 40 connecting the cavity 30 to the rear trailing edge of the blade 1. The wavy grooves 40 are constructed with the wave on the meeting surface of side wafer 14 being offset from that of side wafer 16 so that the top of the wave of the groove on side wafer 14 is over the bottom of the wave on side wafer 16, forming a criss-cross pattern. Note groove 40B in phantom on wafer 16. While the grooves 40 may be formed of many wavy shapes, they are shown as formed of short straight sections connected by curved sections. In the pattern from top to bottom of a side wafer, the wavy passages are equally spaced. The grooves 40, as seen in FIG. 4, have their straight portions of constant cross-sectional area as at A, with the curved portion being spaced further apart as at B. The purpose of the larger area in the curved section is to reduce the pressure drop associated with the turning by reducing the velocity within the turn. The ends of the grooves 40 can continue the same size as the groove 40 to the trailing edge of the blade 1, or the passages can be reduced in cross section as shown in FIG. 4 at 42 to control flow through the grooves. In another embodiment, the larger area in the curved sections permits a turning vane within a curved section to further aid in reducing the pressure drop, and in addition, the turning vanes increase the coolant surface area which will increase heat transfer. An example of a turning vane is shown at C in FIG. 4.

FIG. 3A shows a modification where a plate 50 is placed between the side wafers 14A and 16A to separate the flow through the wavy passages 40A and 42A.

The wafers 8 of the forward part of the blade 1 can be formed as set forth in U.S. Pat. No. 3,872,563, while the rearward part of the blade is formed by side wafers 14 and 16 extending from the last wafer 8 with the wavy grooves therebetween forming a criss-cross pattern.

I claim:

1. An airfoil shaped member having pressure and suction walls formed of radial wafers wherein the forward portion is formed of a plurality of parallel radial wafers bonded together having a hollow cavity therein for receiving a cooling fluid, cooling passages formed in the pressure and suction walls of said airfoil shaped member between the surface of abutting radial wafers, two side wafers bonded to the last parallel radial wafer and extending therefrom at an angle forming the trailing edge region of said airfoil shaped member, said side wafers having wavy grooves on the meeting surfaces thereof whereby the wavy grooves of each side are offset from each other in parallel planes, said grooves being connected to said cavity at one end and to the trailing edge of the blade at the other end, said wavy grooves of one side wafer crossing over the wavy grooves of the other side wafer, each groove on its side wafer forming a single passage.

2. A combination as set forth in claim 1 wherein said grooves are formed having straight sides with curved sections where the grooves change direction.

3. A combination as set forth in claim 1 wherein said grooves appear in a desired pattern with the side portions of the grooves being of constant cross-sectional areas while the top and bottom curved sections of the grooves are formed of a larger cross-sectional area to reduce the pressure drop associated with the turning.

4. A combination as set forth in claim 1 wherein a flat plate is placed between the wavy grooves on the meeting surfaces of the side wafers for separating the flow through the grooves.

* * * * *

UNITED STATES PATENT AND TRADEMARK OFFICE

CERTIFICATE OF CORRECTION

PATENT NO. : 4,203,706

DATED : May 20, 1980

INVENTOR(S) : W. Graig Hess

It is certified that error appears in the above-identified patent and that said Letters Patent are hereby corrected as shown below:

| | |
|---|---|
| Col. 1, line 7 | "ot" should read -- to -- |
| Col. 4, line 10 | "surface" should read -- surfaces -- |
| Col. 4, line 15 | after "side" insert -- wafer -- |

Signed and Sealed this

*Eleventh* Day of *November 1980*

[SEAL]

*Attest:*

SIDNEY A. DIAMOND

*Attesting Officer*

*Commissioner of Patents and Trademarks*